US012286780B2

(12) United States Patent
Herrmann

(10) Patent No.: US 12,286,780 B2
(45) Date of Patent: Apr. 29, 2025

(54) TOILET BOWL ODOR EXTRACTOR SYSTEM

(71) Applicant: Vincent Lee Herrmann, Scottsdale, AZ (US)

(72) Inventor: Vincent Lee Herrmann, Scottsdale, AZ (US)

( * ) Notice: Subject to any disclaimer, the term of this patent is extended or adjusted under 35 U.S.C. 154(b) by 0 days.

(21) Appl. No.: 18/657,722

(22) Filed: May 7, 2024

(65) Prior Publication Data

US 2024/0376701 A1 Nov. 14, 2024

Related U.S. Application Data

(60) Provisional application No. 63/464,819, filed on May 8, 2023.

(51) Int. Cl.
*E03D 9/052* (2006.01)
*A47K 13/30* (2006.01)
*E03D 5/10* (2006.01)

(52) U.S. Cl.
CPC ..... *E03D 9/052* (2013.01); *A47K 13/307* (2013.01); *E03D 5/105* (2013.01)

(58) Field of Classification Search
CPC ..... A47K 13/307; E03D 9/04–052
See application file for complete search history.

(56) References Cited

U.S. PATENT DOCUMENTS 4,094,023 A 6/1978 Smith
4,726,078 A 2/1988 Carballo
4,893,359 A * 1/1990 Vu ..... E03D 9/052 4/216
5,079,783 A * 1/1992 Haletsky ..... A47K 13/307 4/352
5,345,617 A 9/1994 Jahner et al.
(Continued)

FOREIGN PATENT DOCUMENTS

GB 1282664 * 7/1972 ..... E03D 9/052
GB 2143872 * 2/1985 ..... E03D 9/052

OTHER PUBLICATIONS

Purefresh, kohler.com. https://www.us.kohler.com/us/purefresh-round-front-toilet-seat/productDetail/toilet-seats/1065580.htm?skuId=1065495&id=ps_goo_kbus_dtc_pmax_buy_pmax_toilet_x_x_all_2022_goo_&ds_cid=71700000096982368&ds_agid=&ds_kid=&ds_clid=CjwKCAjw1lCZBhAzEiwAFfvFhGCBE87Cvz7cokLdhRtREYl1JBIV_mLmoc4RJohDikghNEiRUphFRoCkmEQAvD_BwE&gclid=CjwKCAjw1lCZBhAzEiwAFfvFhGCBE87Cvz7cokLdhRtREYl1JBIV [Date accessed: Nov. 17, 2022].

*Primary Examiner* — David P Angwin
*Assistant Examiner* — Nicholas A Ros
(74) *Attorney, Agent, or Firm* — Bold IP PLLC; Binita Singh

(57) ABSTRACT

A toilet structure comprising an odor extract system. The structure includes a toilet seat which is attachable to a toilet. The toilet seat has a hollow structure and includes multiple vent holes distributed on a bottom surface of the toilet seat which traverse into the hollow interior. The multiple vent holes are each covered with a cap that directs air toward the multiple holes and prevents liquid or other toilet debris to enter the multiple holes. An opening is located on a back end of the toilet seat and the opening connects the hollow interior to an air intake mechanism. A gasket strip is integrated along a perimeter on the bottom surface of the toilet seat between the multiple vent holes and an outer edge of the toilet seat to create some space between the bottom surface and the toilet for the air to enter the multiple vent holes.

11 Claims, 3 Drawing Sheets

(56) References Cited

U.S. PATENT DOCUMENTS

| | | | | |
|---|---|---|---|---|
| 6,237,163 | B1 * | 5/2001 | Guzzo | E03D 9/05 4/352 |
| 6,615,410 | B1 * | 9/2003 | Gurrola | E03D 9/052 4/213 |
| 6,678,900 | B2 | 1/2004 | Ware | |
| 7,380,292 | B1 * | 6/2008 | Harris | A47K 13/10 4/213 |
| 7,921,477 | B2 * | 4/2011 | Casale | A47K 13/307 4/216 |
| 9,382,915 | B2 | 7/2016 | Jones | |
| 9,808,132 | B2 | 11/2017 | Smith | |
| 10,168,679 | B2 * | 1/2019 | Tyson | A47K 13/307 |
| 2006/0277671 | A1 | 12/2006 | Jones | |
| 2007/0186334 | A1 | 8/2007 | Carter et al. | |
| 2008/0040842 | A1 * | 2/2008 | Sanabria | A47K 13/307 4/213 |
| 2008/0086800 | A1 | 4/2008 | Entrekin | |
| 2009/0235442 | A1 | 9/2009 | Lee | |
| 2009/0307831 | A1 | 12/2009 | Shahar | |
| 2010/0257667 | A1 | 10/2010 | Kennedy | |
| 2011/0099697 | A1 * | 5/2011 | Weigart | A47K 13/307 4/217 |

* cited by examiner

TOILET BOWL ODOR EXTRACTOR SYSTEM

CROSS-REFERENCE TO RELATED APPLICATIONS

This application is a non-provisional application which claims priority to U.S. Provisional Application No. 63/464,819 filed on May 8, 2023, which is incorporated by reference in its entirety.

TECHNICAL FIELD

The present invention relates generally to toilets, and in particular to ventilation systems for toilets.

BACKGROUND

Humans eat food and what is not digested or absorbed by the gastrointestinal system results in excrement or feces. This is a normal process where the human defecates the excrement through the anus. Also normal to the process is that excrement has an unpleasant odor. The smell comes from bacteria in the intestinal tract that break down food during digestion.

It is commonplace to use a toilet bowl to deposit excrement. The user is usually using a toilet that is situated in a confined room. Unfortunately, unpleasant smells of the excrement are released into the confines of the room and the smells may remain after the user has completely defectated, flushed the toilet, and left the room. Toilet rooms may be well ventilated with a window or a ceiling extractor, or both. The problem with such can be that the unpleasant odors must diffuse through the room to exit out the window, or toward the ceiling extractor fan, and the consequence of such is that the user still has to inhale the unpleasant smell.

A user may use air fresheners to disguise the unpleasant odors, but that usually does not fully disguise the smell. Other solutions include toilet ventilation systems that are connected to the sewer line; however, these tend to have relatively complicated mechanisms for ventilating odors.

Accordingly, there is still a need to improve on the problem of extracting unpleasant odors emanating from a toilet when defecating, and which may address other existing issues.

SUMMARY

The disclosed device is unique when compared with other known devices and solutions because it provides a structurally different device as a system that may be incorporated onto a toilet bowl or retrofitted thereon. The disclosed device is unique because of its simplicity using a single extractor fan. The disclosed device is also unique because it is set apart from the toilet plumbing. Further the device also aims to automatically shut off the system when a user stands up and flushes the toilet. The device is further distinguishable because it provides easy access to clean air vents.

In accordance with one embodiment, there is provided an odor extractor system for a toilet bowl. The odor extractor system comprises a toilet seat with multiple air vent holes on a bottom surface of the toilet seat. The toilet seat may be hollow, or each of the multiple air vent holes traverse through the toilet seat into a conduit in the toilet seat. Each of the multiple air vent holes is covered with a cup, wherein the cup faces toward a back side of a toilet seat the toilet seat is connected to and the intake of air is directed into each of the multiple air vent holes. The cups will prevent any water or urine from entering the inside of the toilet seat through the multiple air vent holes. The bottom of the toilet seat may be removable for ease of cleaning the hollowed-out part of the toilet seat. The hollowed-out toilet seat supports good air flow from the air vent holes through one or more air vent lines to an intake fan. The hollowed-out portion of the toilet seat also houses wiring for an on/off switch. The on/off switch may be a pressure sensitive sensor, wherein a pressure of a person sitting down on the toilet seat activates the sensor. Additionally, a second pressure sensor may be located behind the lid, such that when the toilet lid is lifted, the second pressure sensor switch is activated. Both sensor switches need to be activated for the intake fan to turn on. A gasket on the bottom surface of the toilet seat creates a seal with a top surface of the toilet bowl rim. The gasket may have open spaces on a front and a back of the toilet seat for air intake if needed. The air vent line may be a tube that is connected to the back of the toilet seat that is operatively in communication with the hollowed-out toilet seat to pull the air through the hollowed-out part of the toilet seat and through the intake fan motor to an output. The output may include attachment to an existing toilet air vent located in a wall of a room the toilet is situated in. Alternatively, the output may include a tube that is connected to the air intake fan and through the wall to exit out of the home. In yet another alternative embodiment, the air intake fan may be connected to an air filter system which extracts the odorous air before it is released back into the room. The sensors are connected to a timer which is connected to the intake fan, wherein when the pressure is removed from either the first sensor, second sensor, or both, the timer starts a count down after which the timer signals the intake motor to shut off.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
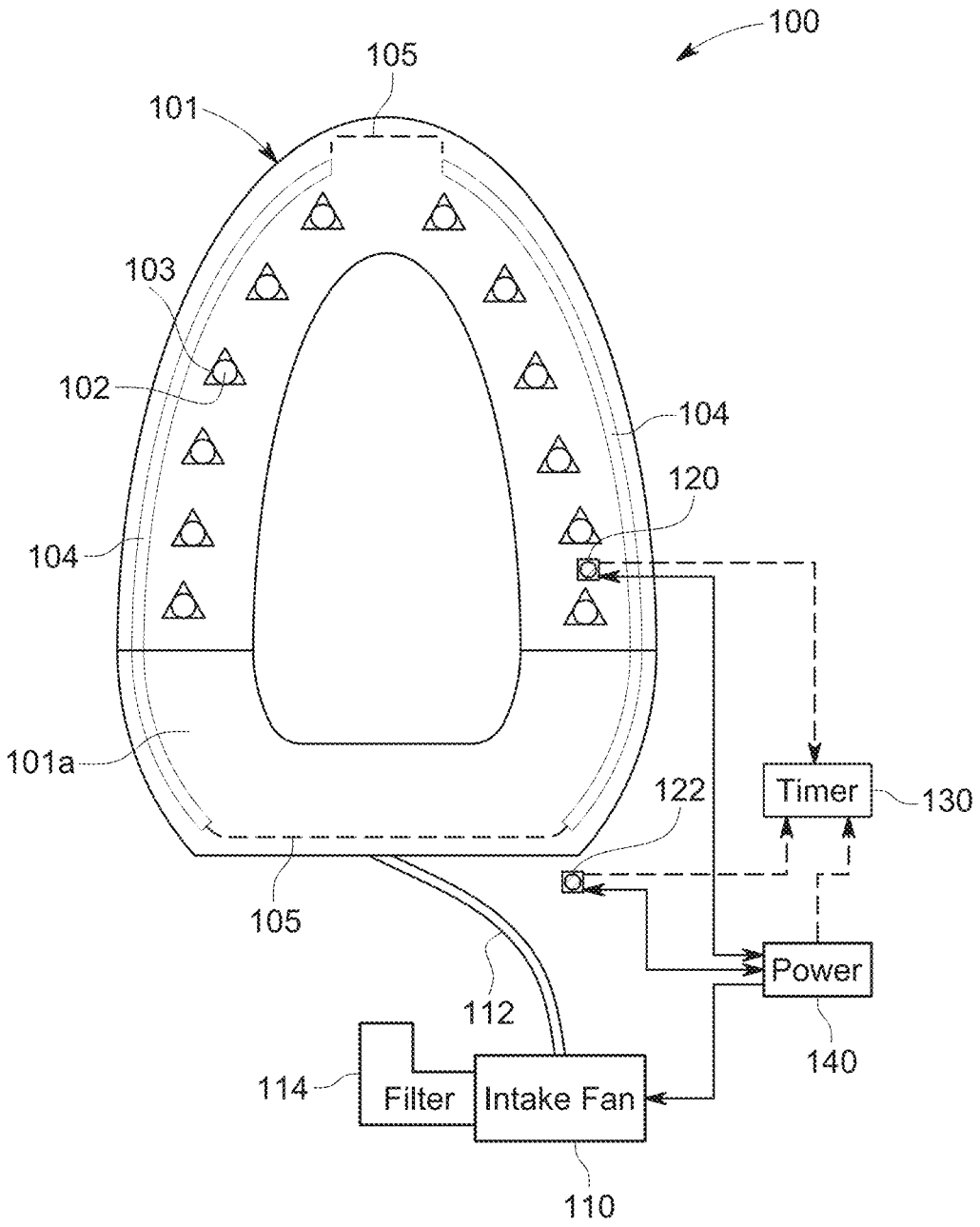
FIG. 1 is a pictorial illustration of an odor extractor system in accordance with an illustrative embodiment.

In the Summary above, in this Detailed Description, the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limits include both numbers. For example, "25 to 100" means a range whose lower limit is 25 and upper limit is 100 and includes both 25 and 100.

Referring now to the drawings and the following written description of the present invention, it will be readily understood by those persons skilled in the art that the present invention is susceptible to broad utility and application. Many embodiments and adaptations of the present invention other than those described herein, as well as many variations, modifications, and equivalent arrangements will be apparent from or reasonably suggested by the present invention and the detailed description thereof without departing from the substance or scope of the present invention. This disclosure is only illustrative and exemplary of the present invention and is made merely for purposes of providing a full and enabling disclosure of the invention.

The present disclosure is generally directed to one or more non-limiting embodiments of an odor extractor system that can be integrated to a conventional toilet. One such example of an odor extractor system is shown in FIG. 1 and is designated by the reference number 100. The odor extractor system is comprised of a toilet seat 101 having a top surface and a bottom surface 101*a*. The toilet seat 101 attaches to a toilet via general means, such as a hinge allowing the toilet seat to be lifted and lowered. The bottom surface 101*a* of the toilet seat 101 includes multiple air vent holes 102 and multiple cups 103, wherein a cup 103 is disposed over each air vent hole 102. The toilet seat 101 also includes a gasket 104 which is attached along an outer edge of the bottom surface 101*a*. Additionally, an interior of the toilet seat 101 may be hollow or alternatively include an air channel extending through a portion or portions of the toilet seat 101 in-line with the multiple air vent holes 102.

The odor extractor system 100 also comprises an air intake fan 110 which is connected to the toilet seat 101 by an air vent line 112. The air intake fan 110 is also connected to an output element, which may be an air filter 114 or alternatively, an air vent in the wall (see, FIG. 3 in OUTPUT) delivering extracted air to an outside of a dwelling the toilet is located in.

As shown in FIG. 1, the toilet seat 101 may be a toilet seat of any conventional design. The toilet seat 101 includes the top surface which may support a user on the toilet, and the bottom surface 101*a* which rests on a top rim of a toilet the toilet seat 101 is connected to. Also shown in FIG. 1, the multiple air vent holes 102 are defined through the bottom surface 101*a* of the toilet seat 101 and which communicate with the hollow space in the toilet seat 101. The hollow space is defined as extending through the entire interior circumference of the toilet seat, which is a space between the top surface and the bottom surface 101*a*. Alternatively, the interior of the toilet seat 101 may include the air channel which may be provided as a narrow channel in communication with the multiple air vent holes 102 through the entire circumference of the toilet seat 101. The bottom surface 101*a* of the toilet seat 101 is detachable from the top of the toilet seat 101, and thus providing ease of cleaning any buildup that may accumulate on the inside of the seat 101. Alternatively, the bottom surface 101*a* is one piece with the rest of the toilet seat 101.

The multiple air vent holes 102 are equally spaced along the bottom surface 101*a* of the toilet seat 101 and following a shape of the toilet seat. It is also to understood that the multiple air vent holes 102 can be bunched up in one or more sides on the bottom surface 101*a*. FIG. 1 shows that a back section of the toilet seat 101 is devoid of any of the multiple vent holes 102. However, it is to be understood that the back section of the toilet seat 101 may also be distributed with multiple air vent holes 102. Also shown in FIG. 1, the multiple cups 103 are fitted over the multiple air vent holes 102. Each of the multiple air vent holes 102 is covered with a single cup from the multiple cups 103. The multiple cups 103 may have a funnel shape that is wider at an opening of the cup and narrower at an opposite end. The multiple cups 103 covering the multiple air vent holes 102 have several advantages. One such advantage is that the multiple cups 103 help direct the odors produced from defecation or urination toward the multiple air vent holes 102. Another advantage is that the multiple cups 103 prevent any fluid from entering the multiple air vent holes 102, such as from urination or splashing of liquid in the toilet bowl. The multiple cups 103 also helps prevent any liquid from accumulating in the hollow space or the air channel in the interior of the toilet seat 101. The multiple cups 103 can be different shapes including novelty shapes, such as a shell shape. Additionally, the multiple cups 103 can be removable so as to be replaceable if needing to change the look or if they are damaged.

FIG. 1 also shows the gasket 104 that is connected to the toilet seat 101 along the bottom surface 101*a*. As shown, the gasket 104 is provided as a strip and extends along a perimeter of the toilet seat 101 between the multiple air vent holes 102 and an outer edge of the toilet seat 101 (i.e., the edge distal to the toilet bowl). The gasket 104 is designed to rest on the toilet rim when the toilet seat is lowered for use, and for creating a space between the toilet seat 101 and the toilet rim such that the toilet seat 101 does not directly rest on the toilet rim. The gasket 104 has a thickness that prevents the multiple caps 103 from touching the toilet rim when the toilet seat 101 is lowered. The gasket 104 is also designed to create a seal when the toilet seat 101 is lowered onto the toilet rim for use, which allows minimal malodorous air from defecation or urination to exit the toilet, ensuring that most air is pulled through the multiple air vent holes 102. The gasket 104 may include gaps 105 at a front and back of the toilet seat 101 to allow some air intake. The gasket 104 can be removable if needing replacement.

The intake fan 110 is coupled to an air intake line 112 wherein the air intake line 112 is coupled to an opening on the back end of the toilet seat 101. The intake fan 110 urges the air inwardly through the multiple air vents 102 in the toilet seat 101 and thus removes/extracts odors from the toilet created during defecation or urination. The odorous air is urged though the multiple air vents 102, through the hollow interior of the toilet seat 101, through the air intake line 112 and into the intake fan 110. The extracted air is then released through an existing air duct line (See, FIG. 3), which is usually in a wall proximal to where a toilet is located, and the odorous air is expelled to an exterior of the dwelling. Alternatively, the extracted air may be directed into an air filter 114 (See, FIG. 1) that removes the odors from the air and releases the air back into a room where the toilet is located. The intake fan 110 is electrically coupled to a power source 140. The power source may be an electrical outlet or the like.

Figure 2:
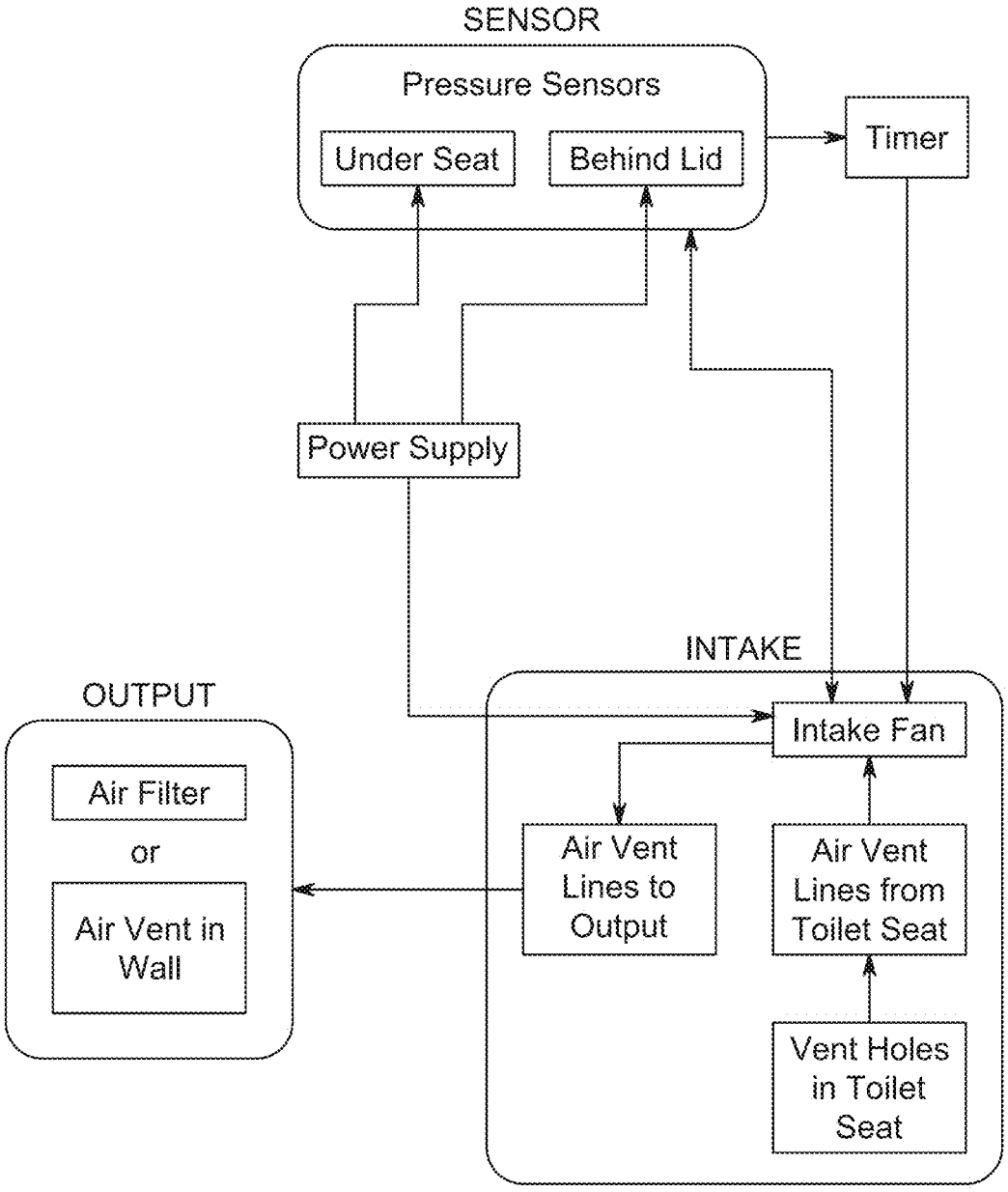
FIG. 2 is a block diagram of an example of an odor extractor system in accordance with an illustrative embodiment.
Figure 3:
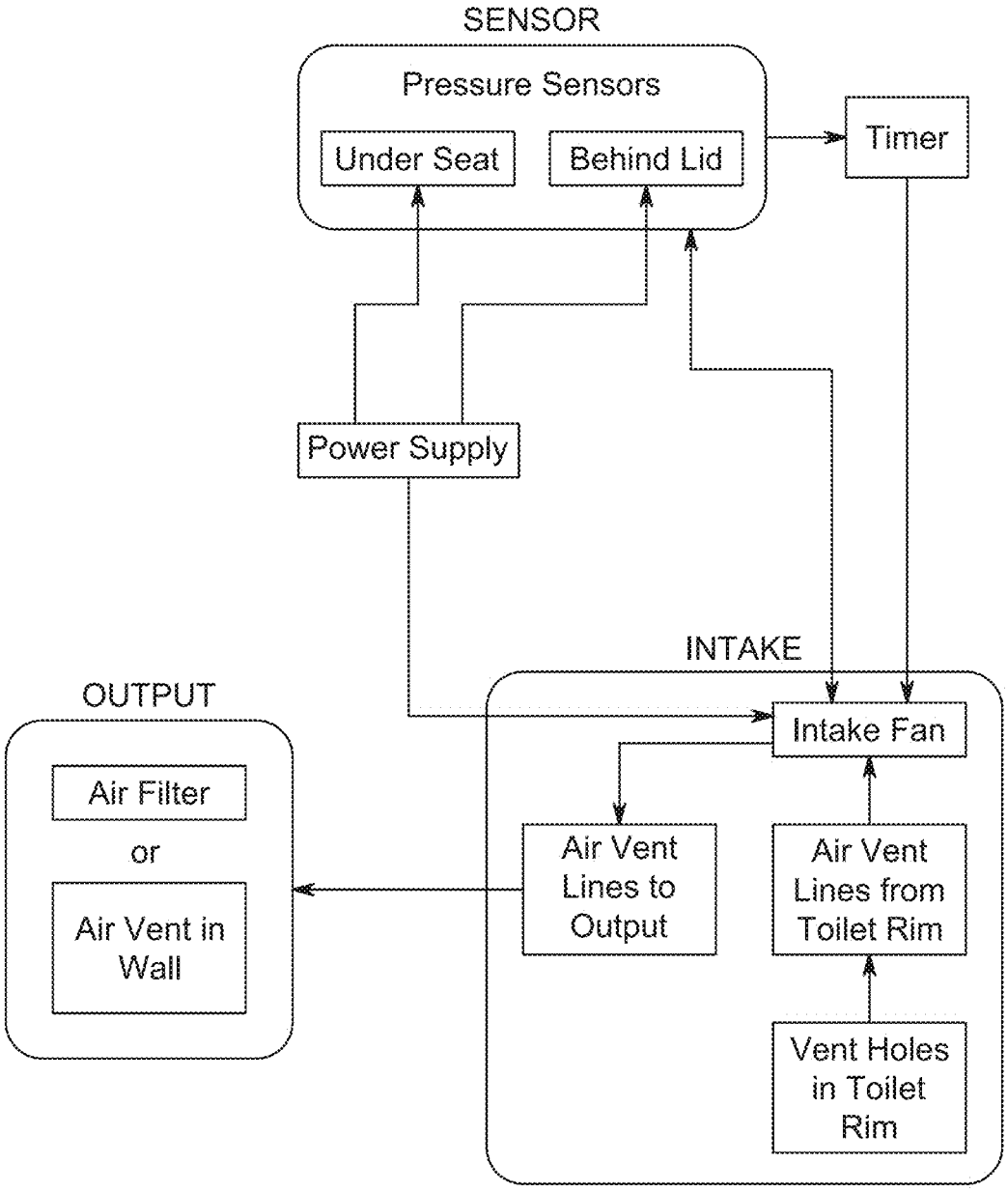
FIG. 3 is a block diagram of an alternative example of an odor extractor system in accordance with an illustrative embodiment.

The intake fan 110 is operatively connected to the one or more sensors, which are depicted in the FIGS. 1-3 as a first sensor 120 and a second sensor 122. The first and second sensor 120, 122 may be pressure sensors. In the non-limiting embodiment depicted in the illustration, both the first and second sensors 120, 122 need to be activated to signal the intake fan 110 to turn on. The first pressure sensor 120 is located on the bottom surface of the toilet seat. The first pressure sensor 120 may be placed under the gasket 104 so that when a user sits on the toilet seat, the first sensor is compressed between the gasket 104 and the toilet rim. The second sensor 122 is located with respect to a lid of the toilet; the second sensor 122 may be located on the toilet rim itself in a location where when the lid is lifted off a toilet rim, a back end of the lid compresses on the second sensor. Alternatively, the second sensor 122 may be located on the lid and positioned relative to the toilet rim wherein the lifting of the lid compresses the second sensor 122. In either embodiment, when the lid is lifted and a user sits on the toilet seat, both the first sensor 120 and the second sensor 122 are activated, thereby sending the signal to the intake fan 110 to turn on. The advantage of having two sensors in such locations ensures that if a user sits on the toilet seat with the lid on top of the toilet seat 101, then the intake fan 110 will not turn on. User's often sit on the toilet with the lid on to dry their feet after a shower, or cut their toenails, and in these situations the intake fan 110 turning on is unnecessary. A user will lift the lid off the toilet seat 101 to sit on the toilet seat to defecate or urinate and thus, in this scenario, the intake fan 101 turning on is necessary. The first and second sensors 120, 122 are also electrically coupled to the power source 140 which can be an electrical output or the like.

In the non-limiting embodiments shown in FIGS. 1-3, a timer 130 is operatively connected to the first and second sensors 120, 122 and to the intake fan. The timer 130 is utilized to shut off the intake fan 110 after the compression pressure is lifted from either the first sensor 120, the second sensor 122, or both. The timer 130 allows the intake fan to stay on and continue to extract air from the toilet bowl for a period after the user has stood up from toilet seat 101 and giving time to the user to flush and generally step away from the toilet. The timer 130 can be set at a user's preference; for example, a user may have the timer 130 signal the intake fan to turn off 30 seconds after the pressure is removed from either of the sensors 120, 122 or both.

Variations of the non-limiting embodiment described above are also possible. As shown in the block diagram of FIG. 3, the odor extractor system 100 can also be equipped on the toilet rim itself. In particular, the multiple vent holes 102 distributed on the toilet seat, as shown in FIG. 1, can alternatively be disposed along the toilet rim, and specifically at the upper edge of the toilet rim. The first and second sensors 120, 122 may still be positioned and function as described above for FIG. 1 and FIG. 2. The flow of air is now diverted through the multiple vent holes in the toilet rim and through an air channel created on an interior of the toilet rim, which is aligned with the multiple vent holes. The air would still be urged through the multiple vent holes, the interior channel and through an opening at a back of the toilet into the connected air vent line to the extractor fan to be released as described above.

Accordingly, the present description provides for various embodiments for the odor extractor system 100 that can be used to extract malodorous air from a toilet while a user is situated on the toilet during defecation or urination. Many uses and advantages are offered by the device 100 as described above in one or more non-limiting embodiments in the present description.

The corresponding structures, materials, acts, and equivalents of any means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention, according to one or more embodiments described in the present description, may be practiced with modification and alteration within the spirit and scope of the appended claims. Thus, the description is to be regarded as illustrative instead of restrictive of the present invention.

What is claimed is:

1. A toilet structure comprising:

a toilet seat having a top surface and a bottom surface, wherein the toilet seat is attachable to a toilet, the toilet seat comprising:

multiple vent holes distributed on the bottom surface, wherein each vent hole of the multiple vent holes is covered with a cup having a shape that is wider at an opening of the cup and narrower at the vent hole;

a hollow interior, wherein the multiple vent holes traverse into the hollow interior;

an opening located on a back end, wherein the opening connects the hollow interior to an air intake mechanism; and a gasket strip integrated along a perimeter on the bottom surface between the multiple vent holes and an outer edge of the toilet seat.

2. The toilet structure of claim 1, wherein the gasket strip includes one or more gaps.

3. The toilet structure of claim 1, wherein the gasket strip rests on a toilet rim when the toilet seat is in a lowered use position, whereby creating a space between the bottom surface of the toilet seat and the toilet rim.

4. The toilet structure of claim 1, wherein the air intake mechanism comprises:

an air intake line coupled to the opening on the back end of the toilet seat;

an air intake fan coupled to the air intake line; and wherein the air intake fan draws air inwardly through the multiple air vents in the toilet seat.

5. The toilet structure of claim 4, wherein the air drawn inwardly through the multiple vents is released though an existing air duct line.

6. The toilet structure of claim 4, wherein the air drawn inwardly through the multiple vents is directed into an air filter and released back into a room where the toilet is located.

7. The toilet structure of claim 1, further comprising a first and second pressure sensors which are operatively connected to an air intake fan of the air intake mechanism, wherein the air intake fan turns on when both the first and second pressure sensors are activated.

8. The toilet structure of claim 7, wherein:

the first pressure sensor is located on the gasket whereby the first pressure sensor is activated when compressed against the toilet rim as a user sits on the toilet seat;

the second pressure sensor is located on a lid of a toilet the toilet seat is connected to, whereby the lifting of the lid activates the second pressure sensor; and wherein activation of both the first and second pressure sensors signals the intake fan to turn on.

9. The toilet structure of claim 7, wherein a timer is operatively connected to the first and second pressure sensors and to the intake fan, wherein the timer is set to a time to signal the intake fan to shut off when a pressure is removed from the first sensor and/or the second sensor.

10. The toilet structure of claim 1, wherein the bottom surface of the toilet seat is removable allowing access to the hollow interior.

11. The toilet structure of claim 1, wherein the gasket strip is removable.

* * * * *